US008474971B2

(12) United States Patent
Okazaki

(10) Patent No.: US 8,474,971 B2
(45) Date of Patent: Jul. 2, 2013

(54) TRANSPORT APPARATUS, RECORDING APPARATUS, AND METHOD OF LOADING A RECORDING MEDIUM

(75) Inventor: Takahiro Okazaki, Chiba (JP)

(73) Assignee: Seiko I Infotech Inc. (JP)

( * ) Notice: Subject to any disclaimer, the term of this patent is extended or adjusted under 35 U.S.C. 154(b) by 62 days.

(21) Appl. No.: 12/998,604

(22) PCT Filed: Sep. 30, 2009

(86) PCT No.: PCT/JP2009/067110

§ 371 (c)(1),
(2), (4) Date: May 23, 2011

(87) PCT Pub. No.: WO2010/055736

PCT Pub. Date: May 20, 2010

(65) Prior Publication Data

US 2011/0242245 A1 Oct. 6, 2011

(30) Foreign Application Priority Data

Nov. 12, 2008 (JP) ..... 2008-290128

(51) Int. Cl.
*B41J 2/01* (2006.01)

(52) U.S. Cl.
USPC ..... 347/104

(58) Field of Classification Search
None
See application file for complete search history.

(56) References Cited

FOREIGN PATENT DOCUMENTS

| | | | |
|---|---|---|---|
| EP | 0754641 | | 1/1997 |
| JP | 06106895 A | * | 4/1994 |
| JP | 2004107021 | | 4/2004 |
| JP | 2005154142 | | 6/2005 |

* cited by examiner

*Primary Examiner* — Stephen Meier
*Assistant Examiner* — Tracey McMillion
(74) *Attorney, Agent, or Firm* — Adams & Wilks

(57) ABSTRACT

A transport apparatus transports a recording medium fed from a feeding roll and wound up onto a take-up roll. A transport roller is arranged in a path between the feeding roll and the take-up roll. A first tension bar is arranged in a path between the transport roller and the take-up roll to apply tension to the recording medium in a first direction different from a transport direction of the recording medium. A second tension bar is arranged in a path between the first tension bar and the take-up roll to apply tension to the recording medium in a second direction different from the first direction. The first and second tension bars apply tension to the recording medium in the first and second directions so that the recording medium is tightened by the first and second tension bars and the tightened recording medium is wound up onto the take-up roll.

20 Claims, 6 Drawing Sheets

TRANSPORT APPARATUS, RECORDING APPARATUS, AND METHOD OF LOADING A RECORDING MEDIUM

CROSS-REFERENCE TO RELATED APPLICATIONS

This application is a U.S. national stage application of International Application No. PCT/JP2009/067110 filed Sep. 30, 2009, claiming a priority date of Nov. 12, 2008, and published in a non-English language.

BACKGROUND OF THE INVENTION

1. Technical Field

The present invention relates to a transport apparatus which prevents slack of a recording medium in a roll shape during its transport, a printer including the transport apparatus, and a method of loading a recording medium onto the printer.

2. Background Art

In a printer for performing printing on a recording medium in a roll shape, the recording medium fed from a feeding roll is wound up onto a take-up roll after the printing is performed in a printing area. To perform desired printing using such a printer, an appropriate tension, that is, a tensile force, needs to be applied continuously to the recording medium so that the recording medium passes through a predetermined position of the printing area precisely. To apply the tension, there is employed a method in which a tension bar having a weight corresponding to a desired tension is placed on a slack portion of the recording medium to eliminate the slack of the recording medium due to the weight of the tension bar itself.

In the conventional printer, however, the tension bar is simply placed on the recording medium, and hence, when the recording medium is transported in an abnormal manner such as meandering, a large force is applied to the recording medium so that the tension bar may vibrate along with the recording medium. This case leads to a problem in that the tension which the tension bar may apply to the recording medium fluctuates. Therefore, the recording medium cannot be aligned at the predetermined position of the printing area, and further wrinkles caused in the recording medium extend in a transport direction, which hinders the desired printing. In addition, when the vibration of the tension bar is large, there may further arise problems of secondary vibration and damage to the recording medium.

Further, when the tension bar is placed on the recording medium, the tension can be applied in the transport direction of the recording medium but cannot sufficiently be applied in a width direction of the recording medium. Hence, warp of the recording medium cannot be suppressed. Further, movement of the recording medium in the width direction cannot be regulated, and hence skewing of the recording medium cannot be suppressed. The warp and skewing may hinder the printed recording medium from being wound up regularly.

To address this, in the apparatus described in Patent Literature 1, that is, JP 2005-154142 A, the tension bar includes pinions at both end portions thereof in a shaft direction, and the pinions mesh with racks provided on the apparatus side, respectively. With this structure, even if a force is applied to the recording medium due to a disturbance or the like, the same height can be maintained at both the ends of the tension bar on the right and left.

CITATION LIST

Patent Literature

Patent Literature 1: JP 2005-154142 A

In the conventional technology, however, when the recording medium is transported in an abnormal manner such as meandering or flapping, a force is applied to one end of the recording medium stretched over the tension bar and to a transport roller. Hence, the other end may become slack and the recording medium may be wound up onto the take-up roll in the slacked state, resulting in irregular winding. Further, when the slack occurs on a platen, the printing quality degrades and further a jam occurs.

In view of the above, the present invention has an object to provide a transport apparatus which prevents slack of a recording medium during transport of the recording medium to thereby prevent irregular winding that may be caused when the recording medium is wound up onto a take-up roll, and maintains a tension applied to the recording medium. The present invention also has an object to provide a printer including the transport apparatus.

Further, the present invention has an object to provide a method for easy loading of a recording medium and easy placing of tension bars after the recording medium is loaded.

SUMMARY OF THE INVENTION

In order to solve the above-mentioned problems, the present invention provides a transport apparatus for transporting a recording medium in a roll shape while applying a tension thereto, the recording medium being fed from a feeding roll and wound up onto a take-up roll. The transport apparatus includes at least two tension bars for biasing the recording medium in different directions. Specifically, the transport apparatus includes: a first tension bar for applying a tension in a direction different from a transport direction of the recording medium; springs for biasing at least two portions of the first tension bar independently; support plates including guide holes for guiding a moving direction of the first tension bar in a predetermined direction; a second tension bar substantially in a columnar shape, which is placed on the recording medium to apply a predetermined tension to the recording medium, and includes concentric pinions in at least two portions thereof; and a support member including racks meshing with the pinions, respectively, to support the second tension bar.

Further, in the transport apparatus of the present invention, the second tension bar may move so that a longitudinal direction of the second tension bar is maintained in parallel to a longitudinal direction of the take-up roll.

Further, in the transport apparatus of the present invention, the moving direction of the first tension bar may be different by 90 degrees from a moving direction of the second tension bar.

Further, the present invention provides a recording apparatus including a transport apparatus for transporting a recording medium in a roll shape while applying a tension thereto, the recording medium being fed from a feeding roll and wound up onto a take-up roll. The transport apparatus includes at least two tension bars for biasing the recording medium in different directions. Specifically, the transport apparatus includes: a first tension bar for applying a tension in a direction different from a transport direction of the recording medium; springs for biasing at least two portions of the first tension bar independently; support plates including guide holes for guiding a moving direction of the first tension bar in a predetermined direction; a second tension bar substantially in a columnar shape, which is placed on the recording medium to apply a predetermined tension to the recording medium, and includes concentric pinions in at least two portions thereof; and a support member including racks meshing with the pinions, respectively, to support the second tension bar. The recording apparatus further includes: an ink jet head for performing printing on the recording medium; a platen, which is arranged so as to be opposed to the ink jet head; and paper guides, which are arranged in portions before and after the platen in the transport direction of the recording medium. The first tension bar and the second tension bar are arranged in the paper guide on a downstream side of the transport direction.

Further, in the recording apparatus of the present invention, the paper guide on the downstream side of the transport direction may include an end portion, which is spaced apart from the recording medium by the first tension bar biasing the recording medium, whereby a frictional force between the paper guide on the downstream side of the transport direction and the recording medium is reduced.

Further, in the recording apparatus of the present invention, in order to hold the first tension bar on an inner side of a transport path of the recording medium, which is a position at which the first tension bar is not involved in the transport path, the guide holes may each extend to the position at which the first tension bar is not involved in the transport path of the recording medium, and the paper guide may include a hook in a lower portion thereof on the downstream side of the transport direction, the hook holding the second tension bar on an inner side of the transport path, which is a position at which the second tension bar is not involved in the transport path.

Further, the present invention provides a method of loading a recording medium onto a recording apparatus. The recording apparatus includes a transport apparatus for transporting a recording medium in a roll shape while applying a tension thereto, the recording medium being fed from a feeding roll and wound up onto a take-up roll. The transport apparatus includes at least two tension bars for biasing the recording medium in different directions. Specifically, the transport apparatus includes: a first tension bar for applying a tension in a direction different from a transport direction of the recording medium; springs for biasing at least two portions of the first tension bar independently; support plate including guide holes for guiding a moving direction of the first tension bar in a predetermined direction; a second tension bar substantially in a columnar shape, which is placed on the recording medium to apply a predetermined tension to the recording medium, and includes concentric pinions in at least two portions thereof; and a support member including racks meshing with the pinions, respectively, to support the second tension bar. The recording apparatus further includes: an ink jet head for performing printing on the recording medium; a platen, which is arranged so as to be opposed to the ink jet head; and paper guides, which are arranged in portions before and after the platen in the transport direction of the recording medium. The first tension bar and the second tension bar are arranged in the paper guide on a downstream side of the transport direction. In order to hold the first tension bar on an inner side of a transport path of the recording medium, which is a position at which the first tension bar is not involved in the transport path, the guide holes each extend to the position at which the first tension bar is not involved in the transport path of the recording medium, and the paper guide includes a hook in a lower portion thereof on the downstream side of the transport direction, the hook holding the second tension bar on an inner side of the transport path, which is a position at which the second tension bar is not involved in the transport path. The method includes the steps of: holding the first tension bar at the position of each of the guide holes, at which the first tension bar is not involved in the transport path of the recording medium; holding the second tension bar on the hook; fixing the recording medium to a take-up shaft to form the take-up roll; removing the first tension bar from the hook to place the first tension bar on the recording medium; and moving the second tension bar from the position of the holding so that the spring biases the second tension bar toward the recording medium.

According to the present invention, slacking of the recording medium does not occur even during the abnormal transport, and thus it is possible to transport the recording medium with no slack and prevent the irregular winding when the recording medium is wound up onto the take-up roll. Further, the recording medium is transported with no slack, and thus desired printing can be performed in the printing area of the recording medium. In addition, it is possible to achieve easy loading of the recording medium in a roll shape and easy placing of the tension bars after the recording medium is loaded.

Further, the two tension bars are used for applying the tensions to the recording medium in the different directions, and thus it is possible to eliminate the slack that cannot be eliminated with a single tension bar alone, which prevents the irregular winding in the take-up roll.

DESCRIPTION OF THE INVENTION

Hereinbelow, an embodiment of the present invention is described with reference to FIGS. 1 to 6. The following embodiment is directed to a case where the present invention is applied to an ink jet printer, but the present invention is not limited to this embodiment and its modification examples.

Figure 1:
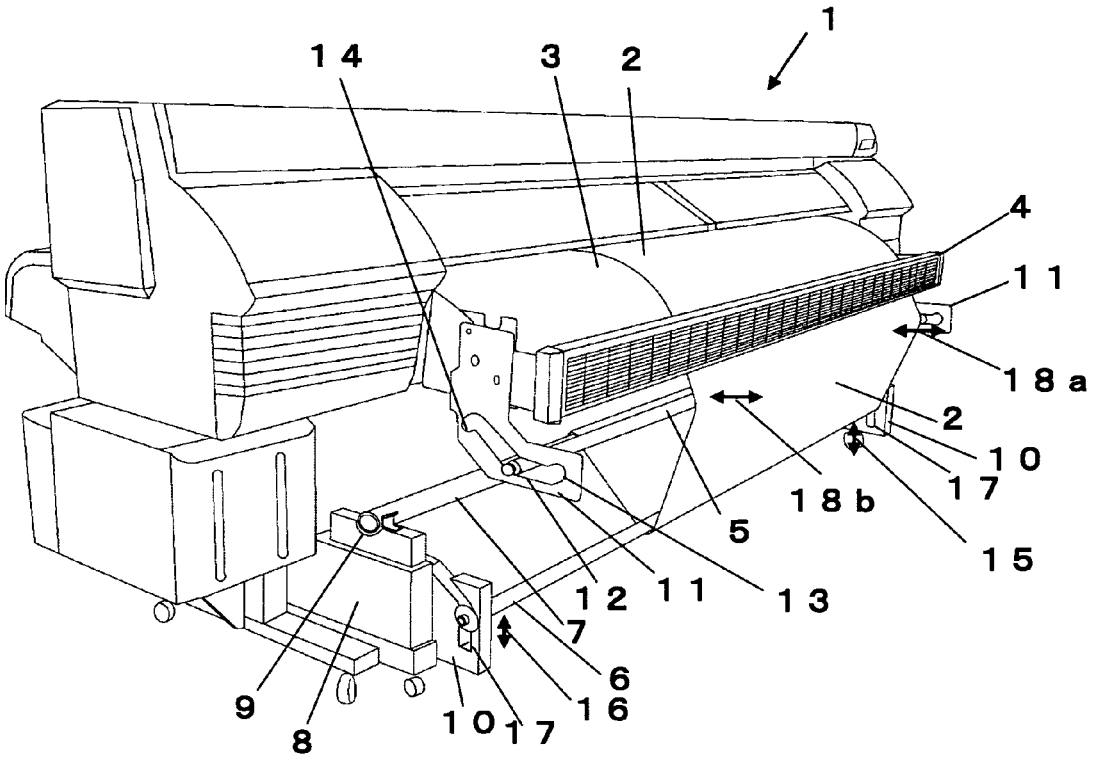
FIG. 1 is a perspective view of an ink jet printer according to an embodiment of the present invention.
Figure 2:
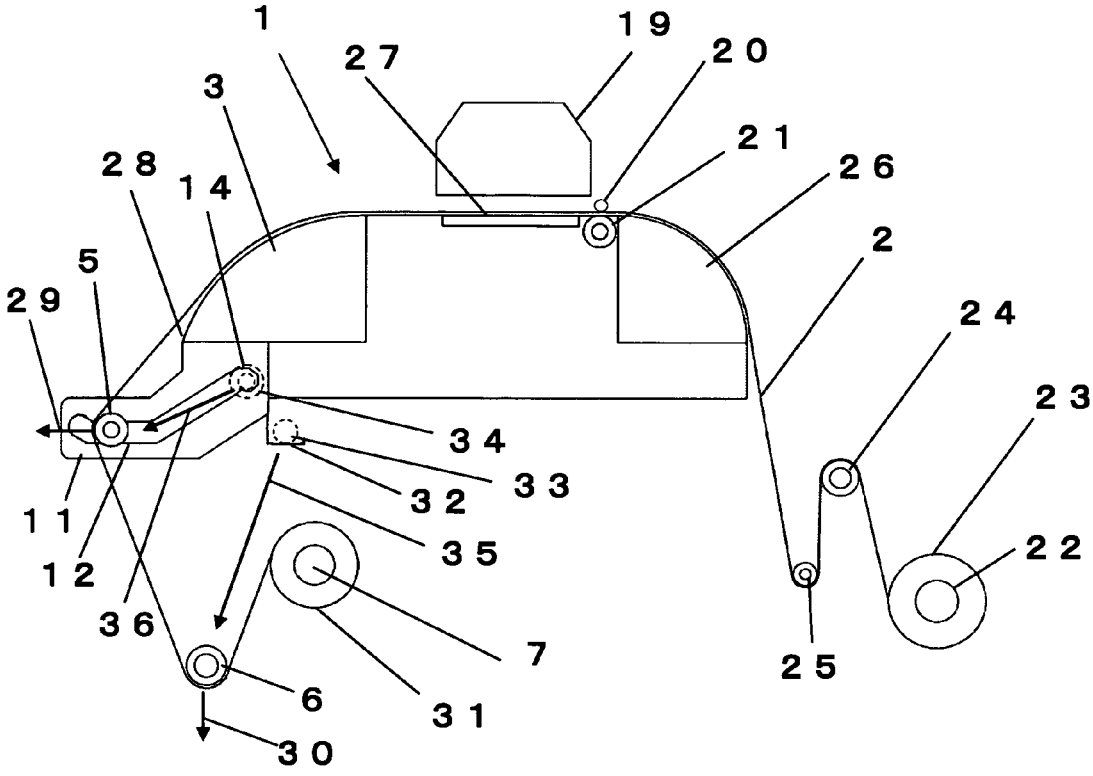
FIG. 2 is a schematic view illustrating a transport path for a recording medium in the ink jet printer according to the embodiment of the present invention.
Figure 3:
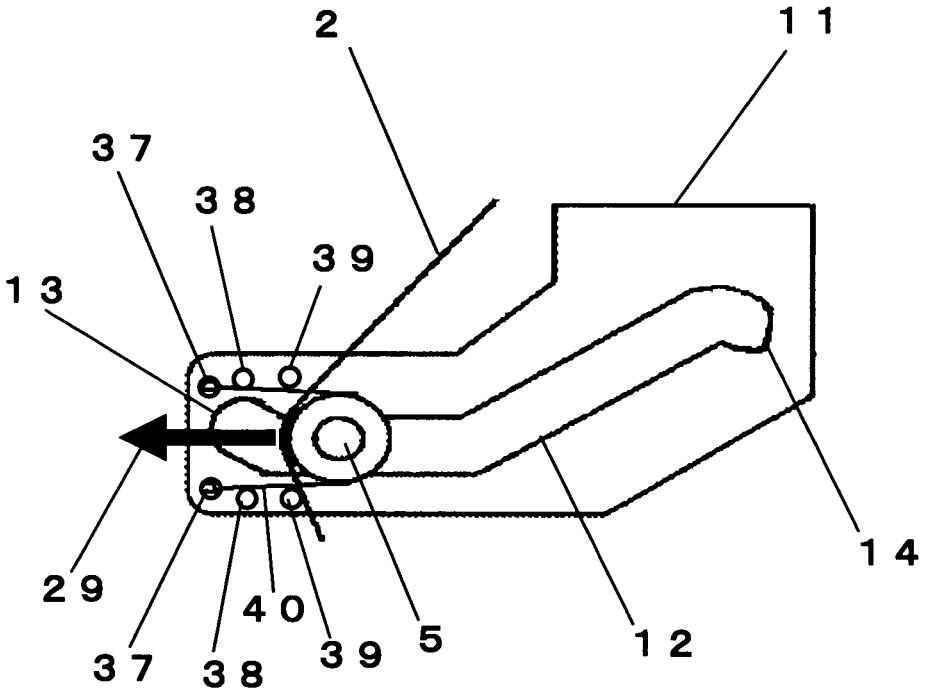
FIG. 3 is a schematic view illustrating part of the transport path for the recording medium according to the embodiment of the present invention.

FIG. 1 is a perspective view of an ink jet printer according to this embodiment. FIG. 2 is a schematic view illustrating a transport path for a recording medium in the ink jet printer according to this embodiment. FIG. 3 is a schematic view illustrating part of the transport path for the recording medium in the ink jet printer according to this embodiment.

An ink jet printer 1 performs printing on a recording medium 2 in a roll shape conforming to a shape of a feeding roll 23. The recording medium 2 used herein has a roll shape and is subjected to printing by an ink jet head (not shown), which is mounted on a carriage 19. Examples of the recording medium 2 include paper, fabric, and plastic sheets.

The recording medium 2 is fed by rotation of a feeding roller 24, and is guided along a feeding-side paper guide 26 including a pre-heater. Downstream of a feeding path in a transport direction, a pinch roller 20 and a grid roller 21 (transport roller) are arranged so as to be opposed to each other at a predetermined interval. The recording medium 2 guided to the feeding path is sandwiched between the pinch roller 20 and the grid roller 21, and is transported by rotation of the grid roller 21 to a printing area, which is sandwiched between a platen 27 and the ink jet head mounted on the carriage 19. The recording medium 2 that has passed through the printing area advances while being guided along a delivery-side paper guide 3 including a post-heater, and is finally wound up onto a take-up roll 31. The take-up roll 31 is driven to rotate by a drive unit controlled by a control unit (not shown). The drive unit is arranged in a take-up apparatus 8.

The ink jet head is mounted on the carriage 19, and includes a predetermined number of nozzles for discharging ink downward. The carriage 19 moves in a width direction of the recording medium 2, which is orthogonal to the transport direction of the recording medium 2. The ink jet head moves in accordance with the carriage 19 while discharging ink from the nozzles onto the transported recording medium 2. On the recording medium 2, a desired image is formed by repeatedly discharging ink and transporting the medium.

The platen 27 arranged below the carriage 19 is a metallic, rectangular plate member in a shape conforming to the width of the recording medium 2. It is preferred that the platen 27 have a suction hole formed therein to suck the recording medium 2.

The feeding-side paper guide 26 and the delivery-side paper guide 3 are provided with the pre-heater and the post-heater respectively onto, for example, the lower surfaces thereof. The pre-heater and the post-heater may be obtained by using, for example, heater coils that generate heat when current is applied. The pre-heater and the post-heater respectively heat, to a predetermined temperature, the recording medium 2 transported along the feeding-side paper guide 26 and the delivery-side paper guide 3 and therefore accelerate drying and fixing of the ink, to thereby improve image quality and shorten a period of time required by the time when the recording medium is wound up.

A feeding-side tension bar 25 is placed on a slack portion of the recording medium 2 between the feeding roller 24 and the feeding-side paper guide 26. Further, a first tension bar 5 and a second tension bar 6 are placed on a slack portion of the recording medium 2 between the delivery-side paper guide 3 and the take-up roll 31. The second tension bar 6 also functions as a roller for directing the recording medium 2 guided by the first tension bar 5 toward the take-up roll 31.

The feeding roll 23 is wound around a feeding roll shaft 22. The feeding roll shaft 22 rotates in accordance with the feeding of the recording medium 2 by the feeding roller 24. The take-up roll 31 is wound around a take-up roll shaft 7. The take-up roll shaft 7 is placed on bearings 9 of the take-up apparatus 8, and is driven to rotate by the take-up apparatus 8.

The feeding-side tension bar 25, the first tension bar 5, and the second tension bar 6 each include a columnar portion having a length in a shaft direction equal to or larger than that of the recording medium 2 in its width direction. Further, the second tension bar 6 is provided with pinions at both ends thereof concentrically with the axis of the columnar portion. The feeding-side tension bar 25, the first tension bar 5, and the second tension bar 6 are arranged so as to extend in the direction orthogonal to the transport direction of the recording medium 2. The extending direction of the feeding-side tension bar 25, the first tension bar 5, and the second tension bar 6 corresponds to the width direction of the recording medium 2 when the recording medium 2 is properly transported. It is preferred that the feeding-side tension bar 25, the first tension bar 5, and the second tension bar 6 be made of metal. The feeding-side tension bar 25, the first tension bar 5, and the second tension bar 6 each have a weight enough to apply a predetermined tension to the recording medium 2 at the corresponding position of arrangement.

The predetermined tension herein refers to a force ensuring that the distance between the nozzles of the ink jet head and the recording medium 2 falls within a range appropriate to printing at least in the printing area sandwiched between the platen 27 and the ink jet head. Note that, the feeding-side tension bar 25, the first tension bar 5, and the second tension bar 6 do not need to have the same diameter of columnar portion and the same weight as long as the predetermined tension may be applied to the recording medium 2.

An air blower apparatus 4 is an air blower for creating a wind in order to dry the ink adhering to the recording medium 2. The air blower apparatus 4 is arranged downstream of the delivery-side paper guide 3 in the transport direction of the recording medium 2, and creates a wind for the recording medium 2 hanging down from the delivery-side paper guide 3.

Although not shown, the second tension bar 6 is provided with the pinions at both the ends of the columnar portion. Further, support members 10 are provided in portions corresponding to both the ends of the second tension bar 6, respectively, and the support members 10 include guide rails 17 having racks meshing with the pinions of the second tension bar 6. The guide rails 17 are provided to the support members 10 so that the second tension bar 6 moves in moving directions 15 and 16 in parallel to the take-up shaft 7. In other words, the second tension bar 6 moves in a guiding direction of the guide rails 17. The second tension bar 6 moves while a force is applied thereto in a downward direction 30 due to the weight of the second tension bar 6 itself. Further, moving amounts of both the ends of the second tension bar 6 are equally regulated by the pinions provided at both the ends of the second tension bar 6 and the racks provided to the guide rails 17.

The second tension bar 6 moves up and down along the guide rails 17 depending on a difference between the transport speed of the grip roller 21 and the pinch roller 20 for the recording medium 2 and the take-up speed of the take-up roll 31 driven by the take-up apparatus 8. Further, it is preferred that the support members 10 be obtained by molding a metal that may support the second tension bar 6 reliably.

In a case of reverse feeding, when the guide rails 17 each extend not only in a vertical direction but also in a slanting direction, the reverse feeding may be performed at the same height for a longer period of time. As described above, at the time of the reverse feeding, the reverse feeding may be performed by utilizing the slack portion of the recording medium 2 instead of reverse rotation of the take-up roll 31. During the reverse feeding as well, the rack and the pinion mesh with each other.

The first tension bar 5 is arranged between the delivery-side paper guide 3 and the second tension bar 6. The first tension bar 5 is supported when both ends thereof are placed in guide holes 12, which are provided in support plates 11. One end side of the guide hole 12 corresponds to a first tension bar standby position 14. The guide hole 12 is a single hole provided in the support plate 11 downward in a slanting direction from the first tension bar standby position 14. The guide hole 12 has a horizontal bottom portion, and another end side 13 thereof is provided upward in a slanting direction. The support plate 11 includes a pair of first spring engaging portions 37, a pair of second spring engaging portions 38, and a pair of third spring engaging portions 39. A spring 40 is engaged with one first spring engaging portion 37 and stretched over the first tension bar 5. Then, the spring 40 is engaged with the other first spring engaging portion 37. As a result, the spring 40 biases the first tension bar 5 in a direction of an arrow 29. By engaging the spring 40 with any one pair of the spring engaging portions 37, 38, and 39, the biasing force may be changed. The biasing force is changed depending on properties of the recording medium 2. Because the another end side 13 is provided upward in the slanting direction, the moving distance of the first tension bar 5 may be increased. This structure may deal with larger slack.

Both ends of the first tension bar 5 are biased by the springs 40, and the moving direction thereof is regulated by the guide holes 12. When the recording medium 2 is slack, the first tension bar 5 moves in accordance therewith. The first tension bar 5 moves in a direction of a double-headed arrow 18*a* in accordance with the slack of the one side of the recording medium 2. Specifically, part of the one side of the recording medium 2 is tightened by the first tension bar 5 and the second tension bar 6 in a portion between the take-up roll 31 and the paired grid roller 21 and pinch roller 20. Further, the first tension bar 5 moves in a direction of a double-headed arrow 18*b* in accordance with the slack of the other side of the recording medium 2. Specifically, part of the other side of the recording medium 2 is tightened by the first tension bar 5 and the second tension bar 6 in a portion between the take-up roll 7 and the paired grid roller 21 and pinch roller 20. At both the ends of the first tension bar 5 and in their vicinity, the first tension bar 5 is supported by the support plates 11, and is biased by the springs 40 (first biasing means) independently. Further, the first tension bar 5 is guided by the guide holes 5 of the support plates 11, and hence the moving direction of the first tension bar is determined from the shape of opening portions of the guide holes 5.

Both ends of the recording medium 2 are biased by the first tension bar 5 independently in the directions different from the transport direction. Hence, the first tension bar 5 applies a tension to the recording medium 2. Further, the second tension bar 6 applies a tension to the recording medium 2 while moving constantly in parallel to the take-up roll 31. In addition, when applying a tension, the first tension bar 5 and the second tension bar 6 moves in the directions shifted by 90 degrees, and hence it is possible to effectively prevent the slack of the recording medium 2. In addition, the second tension bar 6 is maintained in parallel to the take-up roll 31, and hence it is possible to wind up the recording medium 2 onto the take-up roll 31 with no irregular winding. It is desired that the biasing forces be applied to the first tension bar 5 and the second tension bar in directions different from each other, preferably, directions shifted by 90 degrees in terms of efficiency.

The first tension bar 5 is arranged so that the recording medium 2 is spaced apart from an end portion 28 of the delivery-side paper guide 3. With this structure, a frictional force between the recording medium 2 and the delivery-side paper guide 3 may be reduced. Some types of the recording medium 2 have a large frictional force, and hence the recording medium 2 does not advance due to the friction against the delivery-side paper guide 3, which causes the recording medium 2 wrinkled above the platen 27 to hit against the carriage 19, resulting in a jam. However, the present invention may prevent such a trouble. Even if the jam does not occur, the distance between the ink jet head and the recording medium 2 is changed, resulting in degradation of printing quality. The present invention also prevents such a change in distance.

On a back surface of the delivery-side paper guide 3 on a downstream side, a hook portion 32 capable of holding the second tension bar 6 is provided. The hook portion 32 is provided in order to hold the second tension bar 6 that is removed from the support members 10 when the recording medium 2 is replaced. Because the hook portion 32 is provided, the second tension bar 6 only needs to be placed on the recording medium 2 after the recording medium 2 is set to the take-up roll shaft 7, which facilitates the replacement of the recording medium 2. Further, the hook portion 32 is provided on the back surface of the delivery-side paper guide 3, and hence the second tension bar 6 is situated on an inner side of the transport path for the recording medium 2. Thus, the second tension bar 6 only needs to be placed on the recording medium 2 by moving the second tension bar 6 onto the recording medium 2 instead of inserting the second tension bar 6 through the recording medium 2, which facilitates the placing of the second tension bar 6. As an alternative mode to hold the second tension bar 6 other than the hook portion 32, there may be provided a pedestal for supporting both the ends of the second tension bar 6, for example.

Now, a method of loading the recording medium 2 is further described. The feeding-side tension bar 25 is removed to place the feeding-side tension bar 25 at a standby position outside the ink jet printer 1. The first tension bar 5 is disposed at the first tension bar standby position 14, that is, a position of a first tension bar 34 indicated by the dotted line. The second tension bar 5 is disposed at the position of the hook portion 32, that is, a position of a second tension bar 33 indicated by the dotted line. In other words, the first tension bar 5 and the second tension bar 6 are placed at standby positions on the inner side of the transport path for the recording medium 2.

The recording medium 2 drawn from the feeding roll 23 is passed through a portion above the feeding roller 24 and the feeding-side paper guide 26, and is sandwiched between the grid roller 21 and the pinch roller 20. The recording medium 2 is stretched over the feeding roller 24 and is caused to be slack in a portion between the feeding roller 24 and the feeding-side paper guide 26. The feeding-side tension bar 25 is placed on the slack portion. The feeding roller 24 and the grid roller 21 are driven to transport the recording medium 2. Then, the recording medium 2 is transported until the recording medium 2 becomes long enough to be set to the take-up roll shaft 7, and thereafter the transport is stopped. The recording medium 2 is set to the take-up roll shaft 7, and the take-up roll shaft 7 is set to the bearings 9. The second tension bar 6 is moved in a direction of an arrow 35, and the pinions at both the ends thereof are fitted to the racks of the guide rails 17, respectively. The first tension bar is moved in a direction of an arrow 36, and both the ends thereof are biased by the springs 40 in the direction of the arrow 29. In this manner, the first tension bar 5 and the second tension bar 6 may be set with ease, and the recording medium 2 may be loaded onto the ink jet printer 1 with ease.

Figure 4:
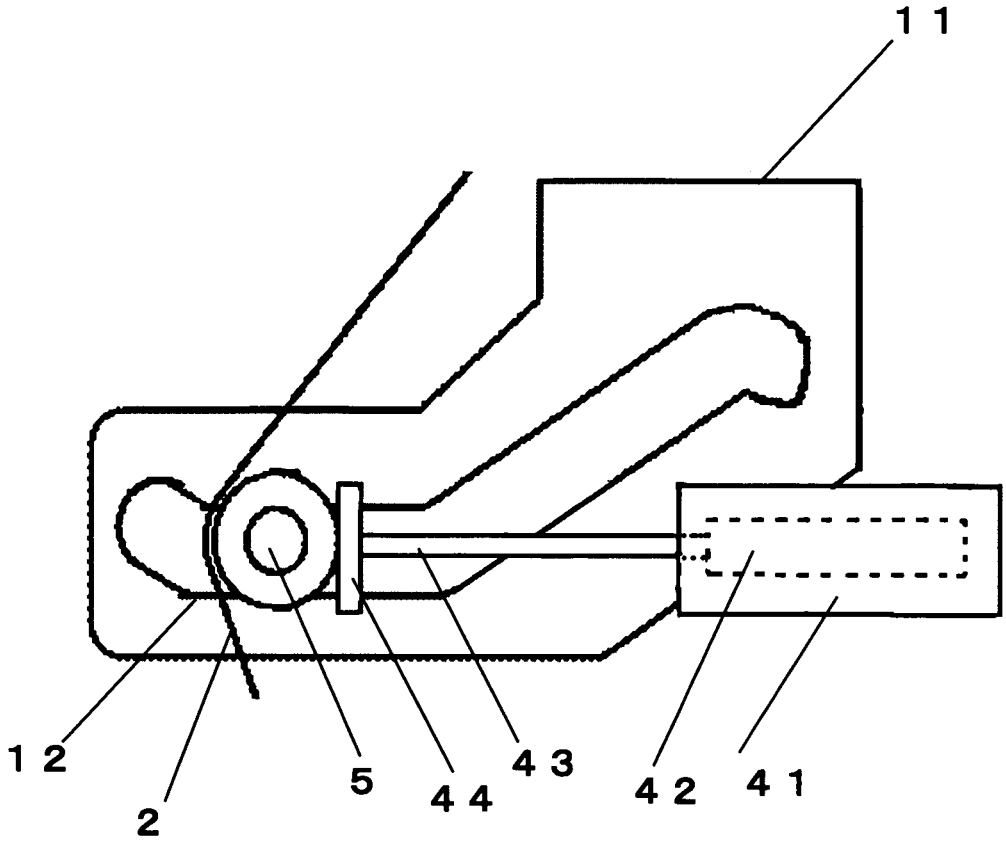
FIG. 4 is a schematic view illustrating biasing means for a first tension bar for the recording medium according to a second example of the embodiment of the present invention.

FIG. 4 is a schematic view illustrating biasing means (first biasing means) for the first tension bar for the recording medium according to a second example of the embodiment of the present invention.

The first tension bar 5 is supported when both ends thereof are placed in the guide holes 12, which are provided in the support plates 11. The support plate 11 has a spring box 41 fixed thereto, the spring box 41 housing a spring 42 for biasing the first tension bar. A shaft 43 is connected to the spring 42, and a receiving portion 44 is connected to one end of the shaft 43. The receiving portion 44 abuts against the first tension bar 5 and receives a force of the spring 42, to thereby press the first tension bar 5.

Figure 5:
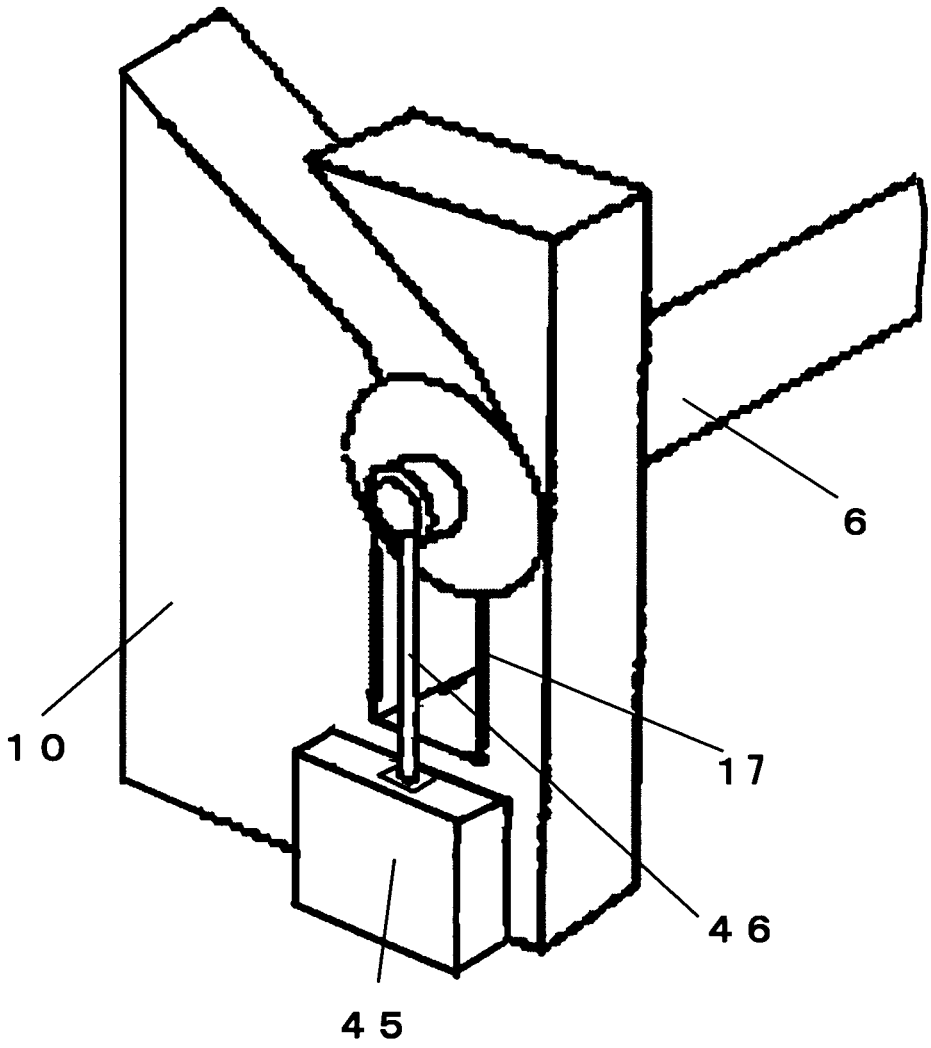
FIG. 5 is a schematic view illustrating a support portion for a second tension bar for the recording medium according to the second example of the embodiment of the present invention.

FIG. 5 is a schematic view illustrating a support portion for the second tension bar for the recording medium according to the second example of the embodiment of the present invention.

The second tension bar 6 is supported by the support members 10. Both ends of the second tension bar 6 are supported by shafts 46 connected to biasing means 45 (second biasing means). Each biasing means 45 draws the shaft 46 in a gravity direction and biases the second tension bar 6 in the gravity direction. The second tension bar 6 is biased downward along the guide rails 17. The moving amounts and moving directions of both the ends of the second tension bar 6 are respectively set equal to each other by the guide rails 17. The recording medium 2 is biased due to the weight of the second tension bar 6 itself, and is further biased by the biasing means 45. This structure is effective when an inflexible recording medium is biased.

Figure 6:
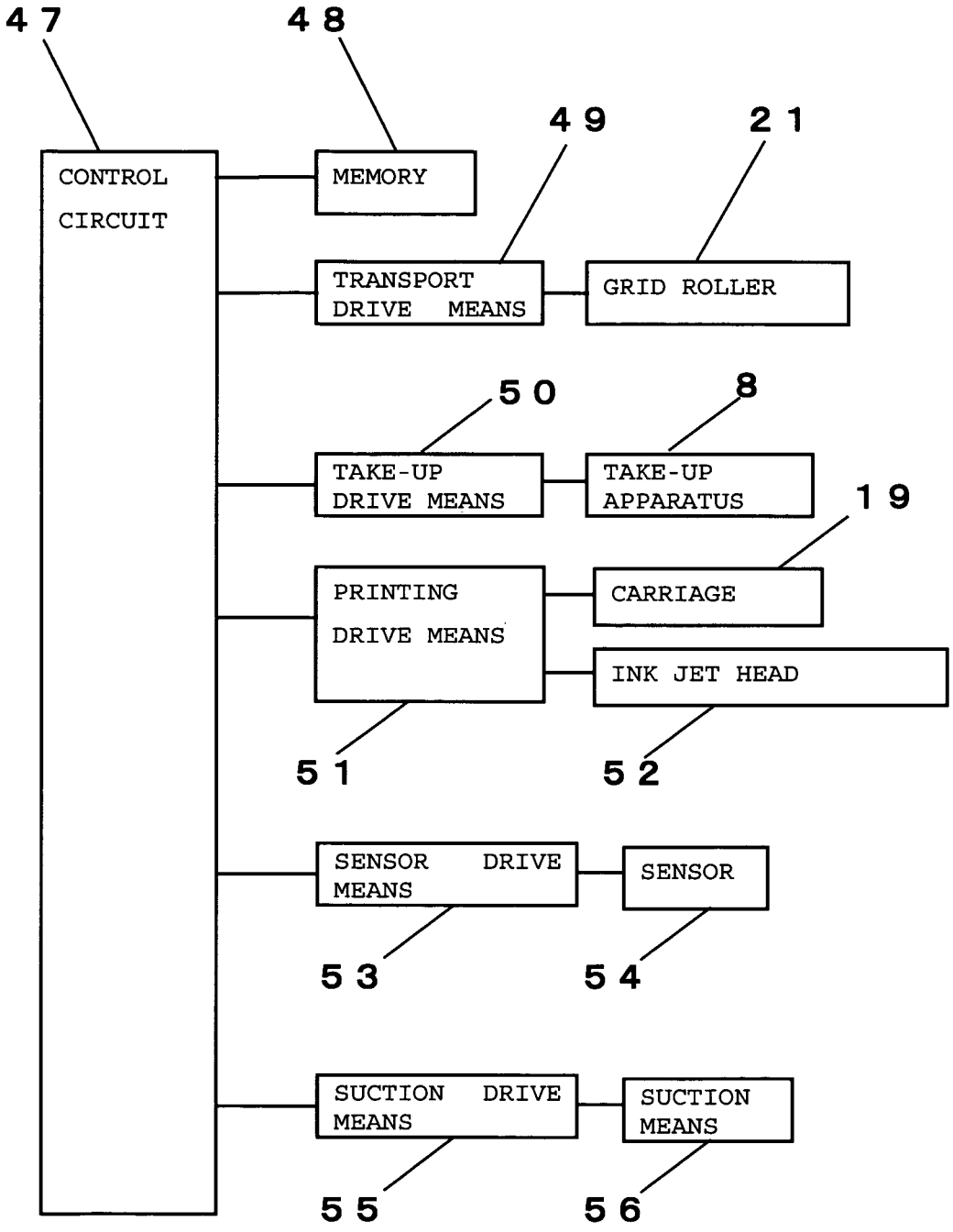
FIG. 6 is a control block diagram of the ink jet printer according to the embodiment of the present invention.

FIG. 6 is a control block diagram of the ink jet printer according to the embodiment of the present invention. A control circuit 47 controls the entire ink jet printer based on a control program stored in a memory 48. The memory 48 is constituted not only by a storage area for the control program, but also by a primary storage area, a storage area for information necessary for control, such as initial setting values, and a storage area necessary for operation at the time of calculation. Transport drive means 49 includes a drive circuit and a drive motor for driving the grid roller 21. The transport drive means 49 operates based on the control by the control circuit 47. Take-up drive means 50 includes a drive circuit and a drive motor for driving the take-up apparatus 8. The take-up drive means 50 operates based on the control by the control circuit 47. Printing drive means 51 includes a drive circuit and a drive motor for driving the carriage 19. Further, the printing drive means 51 includes a drive circuit for driving an ink jet head 52. The printing drive means 51 operates based on the control by the control circuit 47.

The transport drive means 49 drives the grid roller 21 by an amount corresponding to one transport operation, to thereby transport the recording medium. The printing drive means 51 causes the carriage 19 to perform scanning and further causes the ink jet head 52 to discharge ink onto the recording medium, to thereby perform printing. By repeatedly transporting the recording medium and performing printing, a desired image is formed on the recording medium.

When the recording medium is transported a plurality of times without driving the take-up apparatus 8, the recording medium becomes slack and the second tension bar 6 descends gradually. When the second tension bar 6 has descended to a predetermined position, a sensor 54 responds thereto. The sensor 54 is driven by sensor drive means 53, and when the sensor 54 detects the descent of the second tension bar 6 to the predetermined position, the sensor drive means 53 outputs a detection signal to the control circuit 47. When receiving the detection signal, the control circuit 47 outputs a control signal to the take-up drive means 50 to drive the take-up apparatus 8. Accordingly, the recording medium is wound up.

At this time, when the sensor 54 responds, the control circuit 47 controls the grid roller 21 and the take-up apparatus 8 to operate simultaneously. Accordingly, the recording medium is transported and wound up simultaneously. At this time, because of the first tension bar 5 and the second tension bar 6, the recording medium may be wound up with no wrinkles caused on a printed surface and with the irregular winding prevented. In a case of the first tension bar 5 alone, the irregular winding may occur because the first tension bar 5 is not parallel to the take-up shaft 7. In a case of the second tension bar alone, the slack of the recording medium occurs in a portion between the grid roller 21 and the second tension bar, which may cause wrinkles on the printed surface. The first tension bar 5 and the second tension bar 6 are necessary when the grid roller 21 and the take-up apparatus 8 are controlled to operate simultaneously.

The platen 27 has the suction hole formed therein, and suction means 56 sucks the recording medium 2 during the transport of the recording medium 2. The suction means 56 is driven by suction drive means 55. The suction drive means 55 is controlled by the control circuit 47.

When the take-up apparatus 8 is being driven, the control circuit 47 controls the suction drive means 55 so that the suction means 56 sucks the recording medium. Further, when the grid roller 21 is being driven, the control circuit 47 controls the suction drive means 55 so that the suction means 56 sucks the recording medium. In this manner, the recording medium is sucked by the platen during the transport of the recording medium, and thus abnormal transport of the recording medium may be prevented. Further, the tension bars also operate, and hence a greater effect is obtained.

The present invention has been described with reference to the above-mentioned embodiment, but the present invention is not limited to the above-mentioned embodiment, and modifications and changes may be made thereto for modification purposes or as fall within the spirit of the present invention.

INDUSTRIAL APPLICABILITY

As described above, the transport apparatus and the printer according to the present invention are useful for an ink jet printer that performs printing on a medium in a roll shape.

REFERENCE SIGNS LIST

1 ink jet printer
2 recording medium
5 first tension bar
6 second tension bar
7 take-up shaft
8 take-up apparatus
11 support plate
12 guide hole
19 carriage
20 pinch roller
21 grid roller
23 feeding roll
31 take-up roll
32 hook portion

The invention claimed is:

1. A transport apparatus for transporting a recording medium in a roll shape while applying a tension thereto, the recording medium being fed from a feeding roll and wound up onto a take-up roll, the transport apparatus comprising:

a transport roller arranged in a path between the feeding roll and the take-up roll to transport the recording medium;

a first tension bar arranged in a path between the transport roller and the take-up roll for applying a tension to the recording medium in a first direction;

first biasing means for biasing at least two portions of the first tension bar independently from one another;

support plates having guide holes for guiding the first tension bar in a predetermined direction;

a second tension bar arranged in a path between the first tension bar and the take-up roll in parallel to a roll shaft of the take-up roll for applying a tension to the recording medium in a second direction different from the first direction so that the recording medium is tightened by the first and second tension bars and the tightened recording medium is wound up onto the take-up roll, the second tension bar including concentric pinions in at least two portions thereof;

a support member including racks meshing with the respective pinions of the second tension bar to support the second tension bar and to cause the second tension bar to move in parallel to the roll shaft of the take-up roll and in a direction different from a moving direction of the first tension bar;

second biasing means for biasing the second tension bar in a direction different from a biasing direction of the first tension bar biased by the first biasing means;

a flat, plate-shaped platen arranged in a path between the transport roller and the first tension bar; and suction means for sucking the recording medium toward the platen.

2. A transport apparatus according to claim 1; wherein the moving direction of the first tension bar is different by 90 degrees from a moving direction of the second tension bar.

3. A transport apparatus according to claim 1; further comprising:

take-up drive means for driving the take-up roll;

transport drive means for driving the transport roller;

control means for controlling the printing means, the take-up drive means, and the transport drive means; and detection means for detecting a position of the second tension bar;

wherein when the detection means detects that the second tension bar is situated at a predetermined position, the control means drives the take-up drive means irrespective of whether or not the transport roller rotates, to thereby wind up the recording medium by a predetermined amount.

4. A transport apparatus according to claim 1; wherein the suction means sucks the recording medium toward the platen while the transport roller or the take-up roll is being driven.

5. A recording apparatus, comprising:

the transport apparatus according to claim 1;

printing means arranged so as to be opposed to the platen to form an image on the recording medium; and a paper guide arranged in a path between the platen and the first tension bar to guide transport of the recording medium.

6. A recording apparatus according to claim 5; wherein the paper guide comprises an end portion on a downstream side of the transport direction, the end portion being spaced apart from the recording medium by the first tension bar biasing the recording medium, whereby a frictional force between the paper guide and the recording medium is reduced.

7. A recording apparatus according to claim 5; wherein:

in order to hold the first tension bar at a standby position on an inner side of a transport path of the recording medium, which is a position at which the first tension bar is not involved in the transport path, the guide holes of the support plates are configured so as to extend to the standby position; and the paper guide comprises a hook in a lower portion thereof on a downstream side of the transport direction, the hook holding the second tension bar at a standby position on an inner side of the transport path, which is a position at which the second tension bar is not involved in the transport path.

8. A method of loading a recording medium onto the recording apparatus according to claim 7, the method comprising the steps of:

holding the first tension bar at the position of each of the guide holes corresponding to the standby position;

holding the second tension bar on the hook of the paper guide;

fixing the recording medium to a take-up shaft to form the take-up roll;

removing the first tension bar from the standby position to place the first tension bar on the recording medium; and moving the second tension bar from the hook of the paper guide so that the spring biases the second tension bar toward the recording medium.

9. A transport apparatus according to claim 1; wherein the first biasing means comprises a spring.

10. A transport apparatus according to claim 1; wherein the first biasing means further comprises a spring box housing the spring, a shaft connected to the spring, and a receiving portion receiving a force of the spring via the shaft, the receiving portion being connected to an end of the shaft and abutting against the first tension bar to thereby press the first tension bar.

11. A transport apparatus for transporting a recording medium in a roll shape while applying a tension thereto, the recording medium being fed from a feeding roll and wound up onto a take-up roll, the transport apparatus comprising:

a transport roller that is arranged in a path between the feeding roller and the take-up roll to transport the recording medium;

a first tension bar that is arranged in a path between the transport roller and the take-up roll for undergoing movement to apply tension to the recording medium in a first direction different from a transport direction of the recording medium; and a second tension bar that is arranged in a path between the first tension bar and the take-up roll for undergoing movement to apply tension to the recording medium in a second direction different from the first direction, the first and second tension bars applying tension to the recording medium in the first and second directions so that the recording medium is tightened by the first and second tension bars and the tightened recording medium is wound up onto the take-up roll.

12. A transport apparatus according to claim 11; further comprising support plates having guide holes for guiding movement of the first tension bar; and biasing means for biasing the first tension bar along the guide holes.

13. A transport apparatus according to claim 11; further comprising first biasing means for biasing at least two portions of the first tension bars independently from one another; and second biasing means for biasing the second tension bar in a direction different from a biasing direction of the first tension bar biased by the first biasing means.

14. A transport apparatus according to claim 11; wherein the second tension bar has concentric pinions in at least two portions thereof; and further comprising a support member having racks for meshing engagement with respective ones of the pinions to support the second tension bar.

15. A transport apparatus according to claim 11; further comprising a platen that is arranged in a path between the transport roller and the first tension bar; and suction means for sucking the recording medium toward the platen during the transport of the recording medium.

16. A transport apparatus according to claim 11; further comprising means for regulating movement amounts of ends of the second tension bar.

17. A transport apparatus according to claim 16; further comprising support members having guide rails supporting respective ends of the second tension bar; and wherein the means for regulating movement amounts comprises concentric pinions provided at the respective ends of the second tension bar and racks provided on the guide rails of the support members for meshing engagement with pinions.

18. A transport apparatus according to claim 17; wherein the meshing engagement between the pinions and the racks causes the second tension bar to move in a direction parallel to a roll shaft of the take-up roll.

19. A transport apparatus according to claim 11; wherein the first direction is different by 90 degrees from the second direction.

20. A recording apparatus comprising:

the transport apparatus according to claim 11, the transport apparatus having a platen that is arranged in a path between the transport roller and the first tension bar;

printing means arranged so as to be opposed to the platen to form an image on the recording medium; and a paper guide arranged in a path between the platen and the first tension bar to guide transport of the recording medium.

* * * * *